US010283830B2

(12) United States Patent
Hendry

(10) Patent No.: US 10,283,830 B2
(45) Date of Patent: May 7, 2019

(54) HYBRID TM-TE-TM TRIPLE-MODE CERAMIC AIR CAVITY FILTER

(71) Applicant: Nokia Solutions and Networks Oy, Espoo (FI)

(72) Inventor: David R Hendry, Auchenflower (AU)

(73) Assignee: Nokia Solutions and Networks Oy, Espoo (FI)

( * ) Notice: Subject to any disclaimer, the term of this patent is extended or adjusted under 35 U.S.C. 154(b) by 166 days.

(21) Appl. No.: 15/412,150

(22) Filed: Jan. 23, 2017

(65) Prior Publication Data

US 2018/0212295 A1 Jul. 26, 2018

(51) Int. Cl.

| | |
|---|---|
| ***H01P 1/208*** | (2006.01) |
| ***H01P 7/10*** | (2006.01) |
| ***H01P 1/02*** | (2006.01) |
| ***H01P 1/04*** | (2006.01) |
| ***H01P 1/202*** | (2006.01) |

(Continued)

(52) U.S. Cl.

CPC ..... *H01P 1/2084* (2013.01); *H01P 1/02* (2013.01); *H01P 1/045* (2013.01); *H01P 1/202* (2013.01); *H01P 1/2082* (2013.01); *H01P 1/2086* (2013.01); *H01P 1/26* (2013.01); *H01P 5/026* (2013.01); *H01P 7/105* (2013.01)

(58) Field of Classification Search

CPC .... H01P 1/2082; H01P 1/2086; H01P 1/2084; H01P 7/105

USPC ..... 333/206, 207, 223

See application file for complete search history.

(56) References Cited

U.S. PATENT DOCUMENTS 5,808,523 A * 9/1998 Kobayashi ..... H03H 9/6483 333/193

2002/0151332 A1* 10/2002 Eddy ..... H01Q 1/1242 455/561

(Continued)

FOREIGN PATENT DOCUMENTS

EP 3217469 A 9/2017

JP 2000323909 A 11/2000

OTHER PUBLICATIONS

KMW, Black Hole Filter (Triple Mode Technology), downloaded from http://www.kmw.com.kr/eng/product/product_new_3.html on Dec. 7, 2016.

(Continued)

*Primary Examiner* — Rakesh B Patel

(74) *Attorney, Agent, or Firm* — Harrington & Smith

(57) ABSTRACT

An apparatus includes a filter. The filter includes a metal structure forming a cavity and includes a ceramic block, which is suspended in the cavity. The ceramic block has two removed portions, the removed portions removed from two opposing sides of the ceramic block. The ceramic block further has one or more slots that that span a region of ceramic between the two removed portions and connects chambers formed by the two regions with chambers formed by the one or more slots, wherein a combined structure of the ceramic block, cavity, and metal structure supports multiple fundamental TM modes and one fundamental TE mode. The filter comprises multiple coupling structures to couple radio frequency signals into and out of the filter. The apparatus may include multi-cavity filters including one and typically multiple ones of the filters.

25 Claims, 15 Drawing Sheets

(51) Int. Cl.
*H01P 1/26* (2006.01)
*H01P 5/02* (2006.01)

(56) References Cited

U.S. PATENT DOCUMENTS

| | | | | |
|---|---|---|---|---|
| 2006/0097826 | A1 | 5/2006 | Srivastava et al. | 333/219.1 |
| 2009/0256651 | A1 | 10/2009 | Salehi | 333/202 |

OTHER PUBLICATIONS

David Vye, The Magic Behind "Black Hole" Filters, Microwave Journal online, downloaded from http://www.microwavejournal.com/articles/12433-the-magic-behind-black-hole-filters on Dec. 12, 2016.
KMW, KMW BlackHole Filter, video uploaded to YouTube, https://www.youtube.com/watch?v=ptgu2PreKF4, screenshots at the following locations: 21 s (seconds); 24s; 26s; 28s; and 29s, downloaded on Dec. 12, 2016.
Definition No. 3 for "fundamental", Mirriam-Webster online, downloaded from https://www.merriam-webster.com/dictionary/fundamental on Jan. 17, 2017.

* cited by examiner

HYBRID TM-TE-TM TRIPLE-MODE CERAMIC AIR CAVITY FILTER

TECHNICAL FIELD

This invention relates generally to performing measurements on apparatus such as resonators and, more specifically, relates to a measurement structures for performing these measurements.

BACKGROUND

This section is intended to provide a background or context to the invention disclosed below. The description herein may include concepts that could be pursued, but are not necessarily ones that have been previously conceived, implemented or described. Therefore, unless otherwise explicitly indicated herein, what is described in this section is not prior art to the description in this application and is not admitted to be prior art by inclusion in this section.

Band pass filters are used in a radio's front end to let through only wanted frequencies. A band pass filter in a base station radio is generally made from cavity resonators that are coupled together. Macro base station transmit filters require very high quality factor (e.g., Q) resonators with large power handling, which leads to large filters. To reduce the size of the filter, multiple modes per resonating cavity can be exploited. Also, most macro base station filter specifications require very sharp filter selectivity, therefore it is of major advantage to have multiple transmission zeros close to both sides of the passband.

SUMMARY

This section contains examples of possible implementations and is not meant to be limiting.

An exemplary embodiment is an apparatus that comprises a filter. The filter comprises a metal structure forming a cavity and comprises a ceramic block, which is suspended in the cavity. The ceramic block has two removed portions, the removed portions removed from two opposing sides of the ceramic block. The ceramic block further has one or more slots that that span a region of ceramic between the two removed portions and connects chambers formed by the two regions with chambers formed by the one or more slots, wherein a combined structure of the ceramic block, cavity, and metal structure supports multiple fundamental TM modes and one fundamental TE mode. The filter comprises multiple coupling structures to couple radio frequency signals into and out of the filter.

BRIEF DESCRIPTION OF THE DRAWINGS

In the attached Drawing Figures:

FIG. 1A illustrates surface currents for a low frequency (e.g., about 925 megahertz, MHz) TM (transverse magnetic) mode, FIG. 1B illustrates surface currents of a middle frequency (e.g., about 942 MHz) TE (transverse electric) mode, and FIG. 1C illustrates surface currents for a high frequency (e.g., about 959 MHZ) TM mode;

FIG. 2A is a top view (in the Y-X plane) of the filter, FIG. 2B is a side view (in the Z-X plane) of the filter, and FIG. 2C is a perspective view of the filter;

FIG. 4A illustrates a grounded screw in a top face of the metal structure for adjusting a single TM mode, FIG. 4B illustrates a grounded screw in side wall of the metal structure for adjusting a single TM mode, and FIG. 4C illustrates an insulated metal disc in the top face of the metal structure for adjusting the TE mode;

FIG. 5A is a top view of the filter, FIG. 5B is a side vide of the filter, and FIG. 5C is a perspective view of the filter;

DETAILED DESCRIPTION OF THE DRAWINGS

The word "exemplary" is used herein to mean "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

Figure 1C:
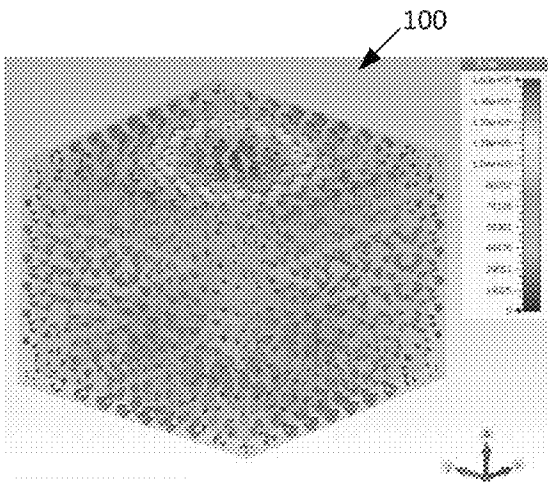
FIGS. 1A, 1B, and 1C illustrate surface currents on a metal structure having an air cavity for a ceramic-loaded hybrid triple-mode ceramic air cavity filter in accordance with an exemplary embodiment, where
Figure 1B:
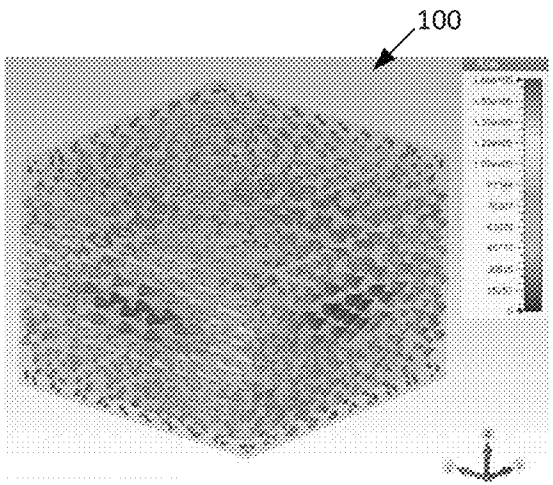
Figure 1A:
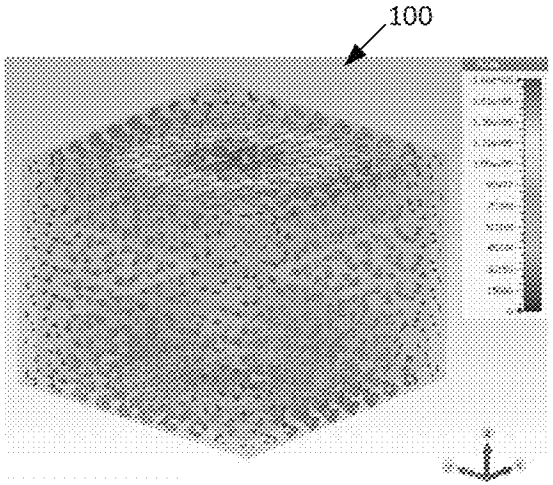

An introduction to the exemplary embodiments will be presented, and then a more detail description will be provided. As an introduction, an aspect of the instant invention includes a band pass filter made from one or more ceramic-loaded hybrid triple-mode air-cavities. The ceramic is shaped in such a way as to allow a single cavity to contain three fundamental modes: two TM modes and one TE mode—hence the term "hybrid". The surface currents for these modes, on a metal structure having an air cavity, can be seen in FIGS. 1A, 1B, and 1C. FIG. 1A illustrates surface currents for a low frequency (e.g., about 925 megahertz, MHz) TM mode, FIG. 1B illustrates surface currents of a middle frequency (e.g., about 942 MHz) TE mode, and FIG. 1C illustrates surface currents for a high frequency (e.g., about 959 MHZ) TM mode.

The TM modes (see FIGS. 1A and 1C) have most of their current travelling across the top and bottom faces of the cavity, from corner to diagonally opposite corner, while the TE mode (see FIG. 1B) has most of its current travelling around the cavity walls. Quality factors, Qs, of around 10,000-30,000 are achievable depending on the ceramic and the frequency. The three modes are orthogonal without any inter-mode couplings. However, the shape of the ceramic (see, e.g., FIG. 2, described below) allows the three modes to resonate at different frequencies, covering the filter band. One of the TM modes is the low frequency mode (illustrated by FIG. 1A), the TE mode is the middle frequency mode (illustrated by FIG. 1B), and the other TM mode is the high frequency mode (illustrated by FIG. 1C). The TE mode allows a low dielectric constant support (examples of which are described below) to be used as in the common TE01 single mode dielectric resonator filters, while the additional two TM modes allow a much smaller filter without sacrificing Q.

A combination of tuning screws, possibly all mounted in the top face of the metal structure, can allow independent tuning of all three modes with good tuning range. Other locations for tuning screws are also possible. An open-ended, top-face-mounted transmission-line connected to a coaxial port allows coupling into or out of all three modes, with flexible control of the coupling amplitudes and transmission zero placement. Alternatively, input coupling can be achieved by an adjacent horizontally mounted air coaxial resonator. Coupling between two triple-mode cavities or between a horizontally mounted air coaxial resonator and a triple-mode cavity may be achieved with a vertical slit iris in a separating cavity wall. The degree of filter selectivity can be controlled by changing the aspect ratio of the triple-mode cavity. Two flexibly placed transmission zeros are generated per triple mode cavity. Additional transmission zeros can be achieved by coupling the input transmission line to the output transmission line.

Figures 2A, 2B:
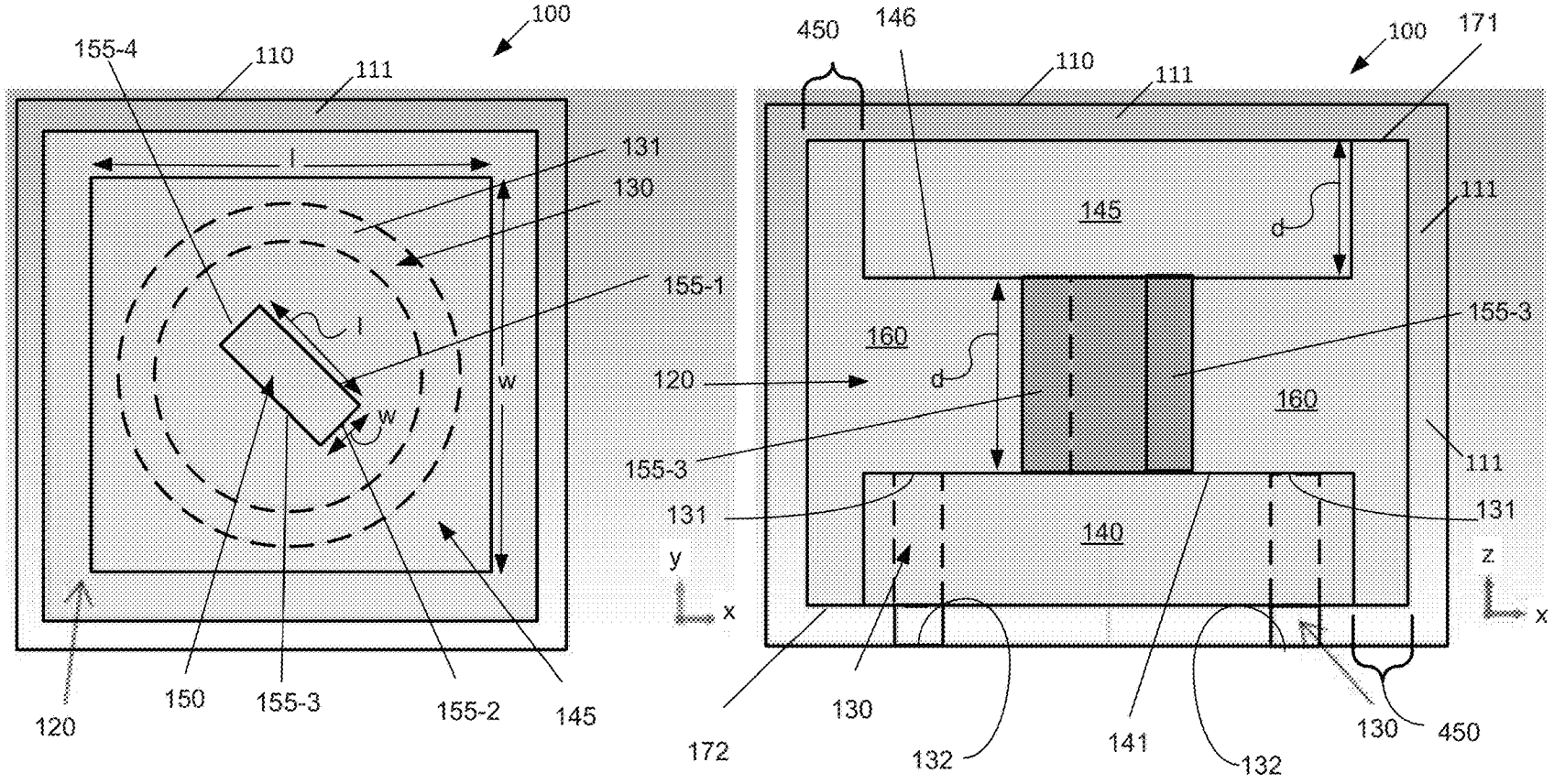
FIGS. 2A, 2B, and 2C are different views of the same exemplary hybrid triple-mode ceramic air cavity filter, in accordance with an exemplary embodiment, where
Figure 2C:
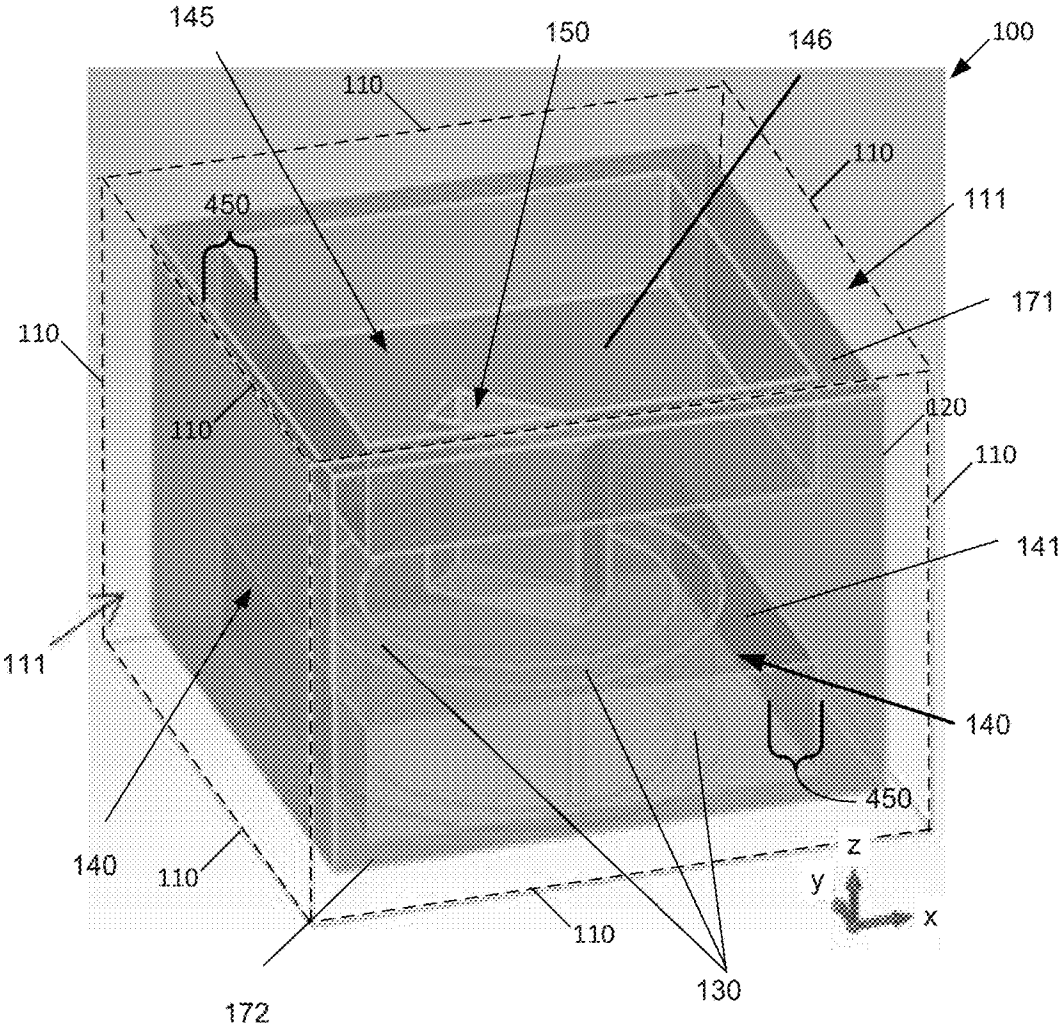

Now that a brief introduction has been presented, more detail is presented. Refer to FIGS. 2A, 2B, and 2C for the following. FIGS. 2A, 2B, and 2C are different views of the same exemplary hybrid triple-mode ceramic air cavity filter 100, in accordance with an exemplary embodiment. FIG. 2A is a top view (in the Y-X plane) of the filter, FIG. 2B is a side view (in the Z-X plane) of the filter, and FIG. 2C is a perspective view of the filter.

In this example, the hybrid triple-mode ceramic air cavity filter 100 is made from a ceramic block 120 mounted within an air cavity 111 created by the metal structure 110, and supported with an alumina (or other low dielectric constant ceramic) support 131. It is noted that the metal structure 110 creates the air cavity 111, and as such the interior dimensions of the metal structure are the exterior dimensions of the air cavity. In this example, the alumina support 130 is cylindrical. The ceramic block 120 has a larger portion 145 of ceramic removed from the top, a larger portion 140 of ceramic removed from the bottom, and a smaller portion of ceramic removed from the middle to form a slot 150. The use of the words "top", "bottom", "side" and the like are based on the X-Y-Z coordinate system shown, but are not limited to this particular coordinate system. The removed portions 140, 145 form air cavities that are referred to herein as chambers to distinguish these from the cavity 111. As can be seen, the removed portions 140, 145 are removed from two opposing sides 171, 172 of the ceramic block 120. The slot 150 also forms a chamber, and the ends of the slot 150 (and its chamber) open to the top 141 of the removed portion 140 and to the bottom 146 of the removed portion 145. The depth of the slot between the two portions 140, 145 is depth d. The slot 150 in this example is a rectangular box shape, wherein a rectangle of the rectangular box shape has two dimensions and one dimension of the rectangle is much longer than the other dimension, and a center of the rectangle is aligned with a center of the ceramic block. The larger removed portions 140, 145 allow the two TM modes and the single TE mode to resonate at around the same frequency, while also shifting the first harmonic spurious modes as high in frequency as possible. In this example, the two larger portions 140, 145 are of substantially the same size and volume (e.g., width w, length l, and depth d). That is, the width, length, and depth for the portion 140 are the same width, length, and depth for the portion 145. Furthermore, the width and length are the same (w=1) in this example (each larger portion 140, 145 is a rectangular box). The removal of the removed portions 140, 145 create a ceramic ridge 450 (see also FIG. 4) around the circumference of the ceramic block on two opposing surfaces. Additionally, the removal leaves a solid (other than what is removed by the slot 150) center portion 160 of the ceramic block 120. It is noted that the removed portions 140 and 145 could be different sizes and still have a functioning filter. In the extreme, one of them could disappear completely, but this would force more current on either the top or bottom surface, resulting in slightly higher filter insertion loss. It is beneficial to keep the fields as symmetric as possible for this reason, but also to minimize the number of parameters that need optimizing, and this entails having removed portions 140 and 145 being of the same or similar sizes.

The alumina support 130 is cylindrical in this example and has an edge 132 that abuts the bottom of the metal structure 110 and an edge 131 that abuts a top 141 of the removed portion 140. The surfaces 141 and 146 are opposing surfaces. The alumina support 130 holds the ceramic block 120 away from the metal structure 110 and suspends the ceramic block 120 in the cavity 111. The support 130 is only one technique to perform this suspension, and others are possible.

The smaller removed portion, referred to as slot 150, is rectangular in the Y-X plane and forms a rectangular box in the Y-X-Z coordinate system in this example, with one dimension (e.g., length l for sides 155-1 and 155-3) much longer than the other (e.g., width w for sides 155-2 and 155-4). This shifts one TM mode higher in frequency than the other TM mode, and allows the TM modes to resonate at the low and high frequencies of the filter band, either side of the TE mode frequency. The slot 150 can be rotated around the Z axis, which rotates the TM modes around the Z axis. The aspect ratio (e.g., proportion between width w and length l) of part 150 depends on the filter bandwidth. A very narrow band filter (say less than one percent fractional bandwidth) would need only a small difference between the frequencies of the two TM modes, and hence would need only a small difference in the side dimensions (of w and l) of part 150. Similarly, a wide bandwidth filter (say approaching 10% fractional bandwidth) would need a larger aspect ratio than that shown in FIG. 2. For reference, many base station front-end filter specifications need around five percent fractional bandwidths, and result in an aspect ratio similar to that found in FIG. 2.

It is noted that a combined structure of the ceramic block 120, cavity 110, and metal structure 110 supports multiple fundamental TM modes and one fundamental TE mode. That is, once RF signals are input into the combined structure, the multiple fundamental TM modes and one fundamental TE mode will be formed because of the way the combined structure is formed. A definition of a fundamental mode is a mode that has a lowest frequency (i.e., the structure does not support lower frequency modes). The use of fundamental modes in a filter generally allows the highest Q per volume, as the fundamental modes generally most efficiently distribute the energy within the structure. The use of fundamental modes also means any spurious modes are always higher in frequency. When all the spurious modes are higher, a low-pass filter can clean them up, but if a filter uses non-fundamental modes, there would exist lower frequency spurious modes requiring a band-pass filter to clean up. A band-pass filter is generally more complicated and generally suffers from poorer insertion loss for the same volume and filtering requirements as a low-pass filter.

Figure 2E:
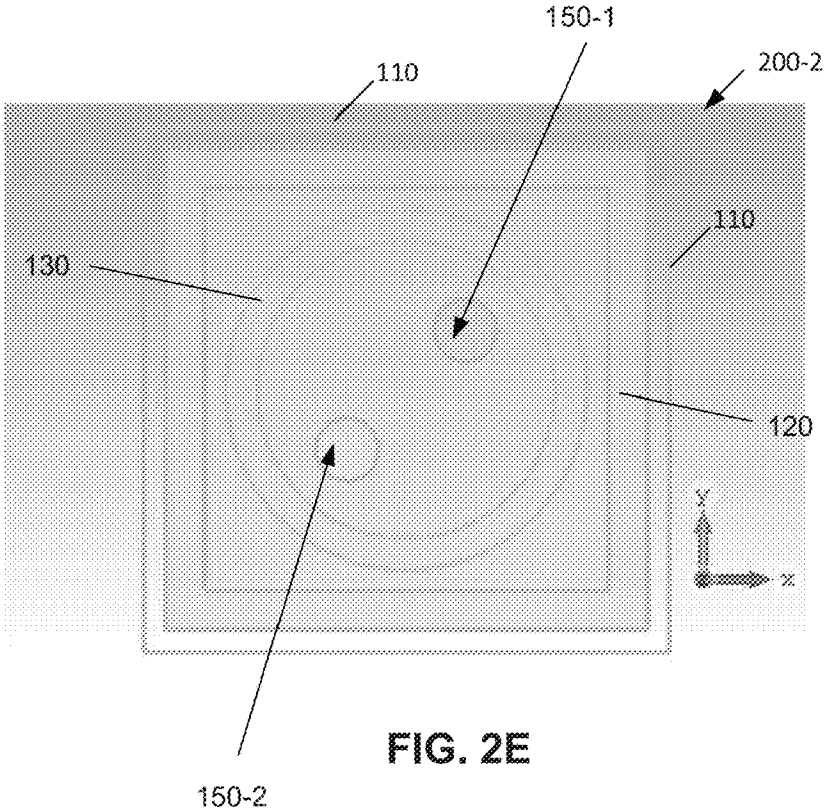
FIGS. 2D and 2E illustrate top views (in the Y-X plane) of an exemplary hybrid triple-mode ceramic air cavity filter similar to that used in FIGS. 2A, 2B, and 2C, but where the rectangular slot has been replaced by a single cylindrical slot (FIG. 2D) or by multiple cylindrical slots (FIG. 2E)
Figure 2D:
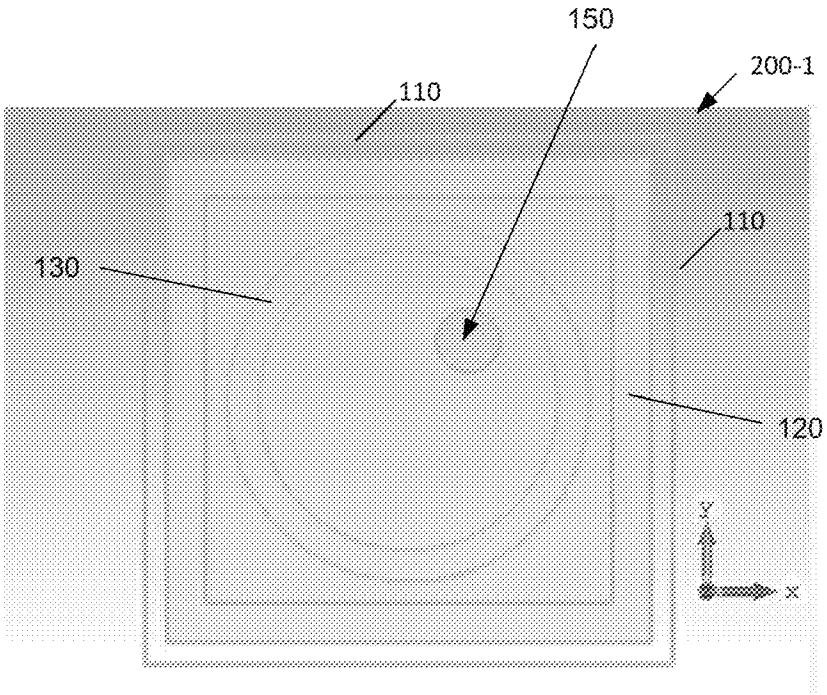

The rectangular profile in the Y-X plane of the slot 150 is merely one example. Other configurations are possible, as illustrated by FIGS. 2D and 2E, which illustrate top views (in the Y-X plane) of an exemplary hybrid triple-mode ceramic air cavity filter similar to that used in FIGS. 2A, 2*b*, and 2C. However, for the filter 200-1 the rectangular slot has been replaced by a single cylindrical slot 150 in FIG. 2D. For filter 200-2, the rectangular slot has been replaced by multiple cylindrical slots 150-1, 150-2 in FIG. 2E.

The metal structure 110 is a cuboid in this example. Typically, width of the cuboid would be equal to length of the cuboid (e.g., within manufacturing tolerances), but the height-to-width ratio depends on the filtering requirements. Very sharp roll-off may require the height to be much smaller than the width, for instance, although this may only be true for filters made from more than one triple mode cavity. A cavity height much smaller than the width makes the current running along the inside cavity walls to be large for the TE mode, and small for the TM modes. As the cavities couple through the walls, weak coupling occurs for the TM modes while strong coupling occurs for the TE mode. With appropriate input/output coupling ratios into the modes, this leads to narrow (or weakly coupled, high external Q) TM modes at the low and high side of the filter pass band and wide (or strongly coupled, low external Q) TE modes at the middle of the filter pass band. This combination of weak-strong-weak modes across the pass band naturally leads to cancellation or transmission zeros close to the band edges.

Figure 3:
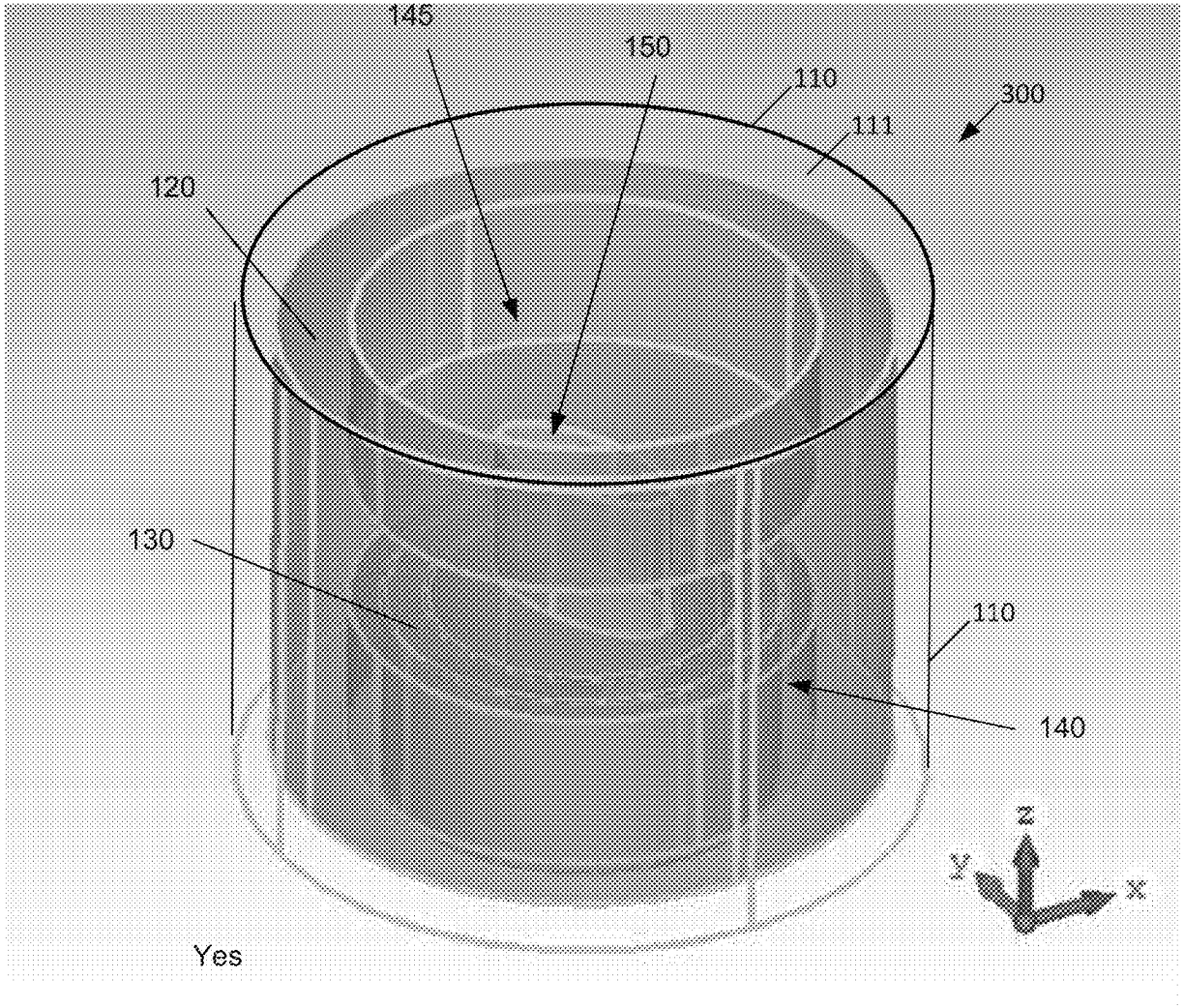
FIG. 3 illustrates a cylindrical hybrid triple-mode ceramic air cavity filter.

The cuboid shape is only one possible shape. As another example, see FIG. 3, which illustrates a cylindrical hybrid triple-mode ceramic air cavity filter 300. The metal structure 110, air cavity 111, ceramic block 120, and larger removed portions 140, 145 could also be cylinders (see FIG. 3), rather than rectangular blocks. Also, the slot 150 could be formed from an ellipsoid shape (as in FIG. 3), or from one small off-center cylindrical hole (see FIG. 2D), or from multiple holes (see FIG. 2E), achieving the same effect as a rectangular slot. This is true for both the cylindrical filter 300 and the cuboid filters 100/200.

Figure 4C:
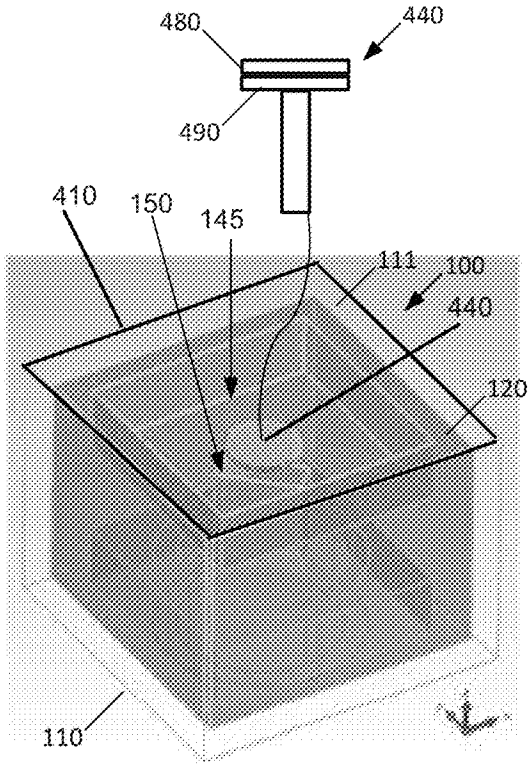
FIGS. 4A, 4B, and 4C present different exemplary embodiments using tuning screws to adjust mode frequencies, where
Figure 4B:
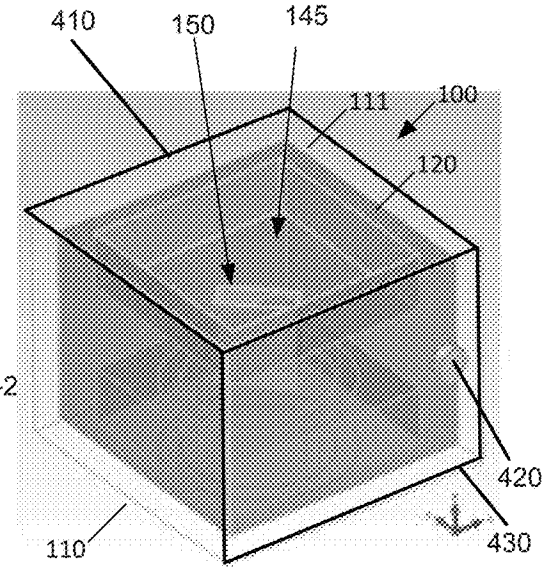
Figure 4A:
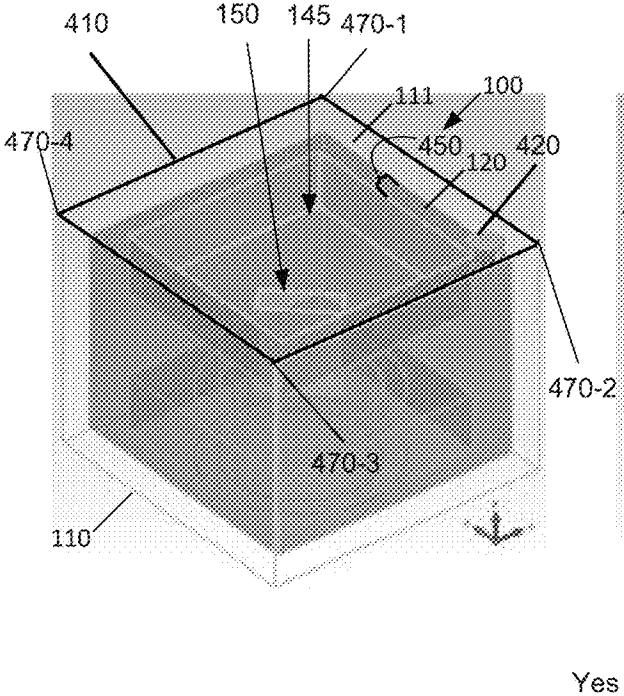

A combination of tuning screws, possibly all mounted in the top face of the metal structure 110, allow independent tuning of all three modes with good tuning range (see FIGS. 4A, 4B, and 4C). The TM modes can be tuned with a metal tuning screw 420 grounded (e.g., by penetrating through the metal structure) to the top face 410 of the metal structure 110, along the ceramic ridge 450 retained after the large portion 145 ceramic removal. See FIG. 4A. There are four corners 470-1, 470-2, 470-3, and 470-4 of the metal structure 110 and therefore the cavity 111. When the slot 150 is rotated 45 degrees about the Z axis, the maximum electric fields for one TM mode will sit in two diagonally opposite corners (e.g., 470-1 and 470-3) of the cavity 111. One way to characterize this is the slot 150 is rotated such that a side along the dimension that is the longer dimension (e.g., the length l) is rotated about the Z axis by 45 degrees relative to a starting point where the longer dimension was aligned with either axis (e.g., X or Y). The slot may be rotated from zero (typically, greater than zero) to 90 degrees about the Z axis, although 45 degrees as described has certain benefits. For the 45 degree rotation example, the other TM mode has electric field maximums in the remaining two diagonally opposite cavity corners (e.g., 470-2 and 470-4). In this case, a tuning screw positioned in a top corner 470 of the cavity (as illustrated by tuning screw 420 in FIG. 4A) will shift one TM mode, without shifting the other TM mode or the TE mode. As the tuning screw gets closer to the ceramic, such as to the ceramic ridge 450, the TM mode decreases in frequency.

Metal tuning screws could also be mounted on the cavity side walls, with similar effect. For example, see the tuning screw 420 mounted on the sidewall 430 of the metal structure 110 in FIG. 4B. The wall mounted screw 420 in FIG. 4B would could still have good orthogonality (adjusting only one mode) with greater tuning range than a lid mounted screw. However, it is desirable to have all tuning elements on one face, e.g., the top face, as this makes tuning easier.

A metal disc 480 (see FIG. 4C) on the end of a plastic screw 490 as an insulated tuning screw 440 positioned in the top face 410 center of the cavity 111 (and the metal structure 110) will shift the TE mode without shifting either of the two TM modes. As the metal disc 480 gets closer to the ceramic of the ceramic block 120, the TE mode shifts higher in frequency. The metal disc 480 could also be a ceramic disc. In this case, the TE mode shifts lower in frequency as the ceramic disc gets closer to the ceramic block 120. It is noted that the plastic screw could be ceramic (e.g., at increased cost) or metal (e.g., at decreased tuning orthogonality).

Figure 5B:
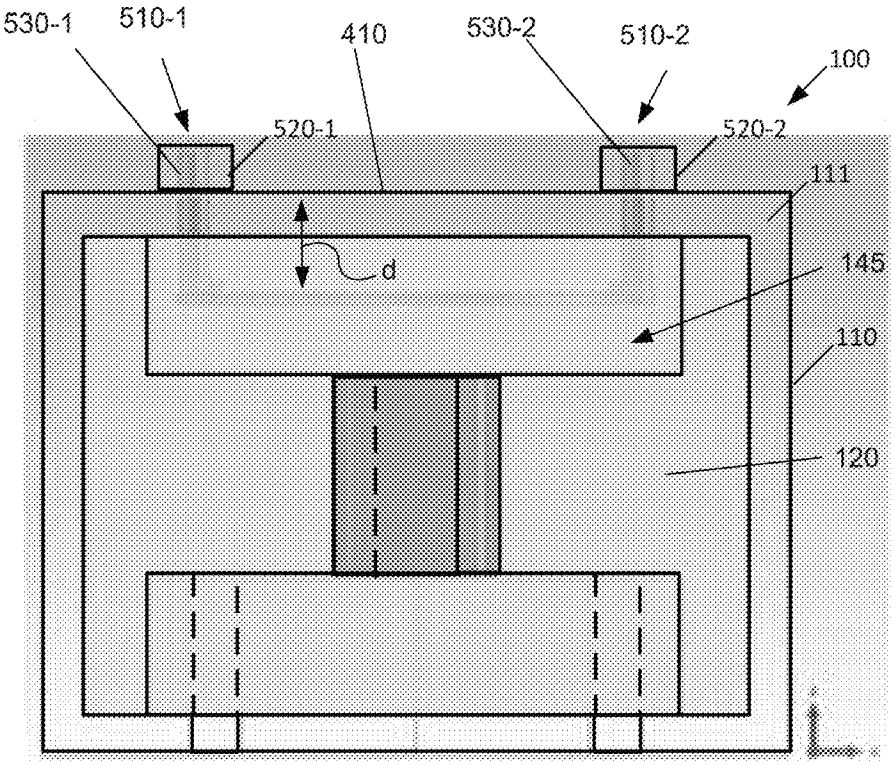
FIGS. 5A, 5B, and 5C are different views of the same exemplary hybrid triple-mode ceramic air cavity filter and present coupling structures for coupling into and out of a triple-hybrid-mode cavity, in accordance with an exemplary embodiment, where
Figure 5A:
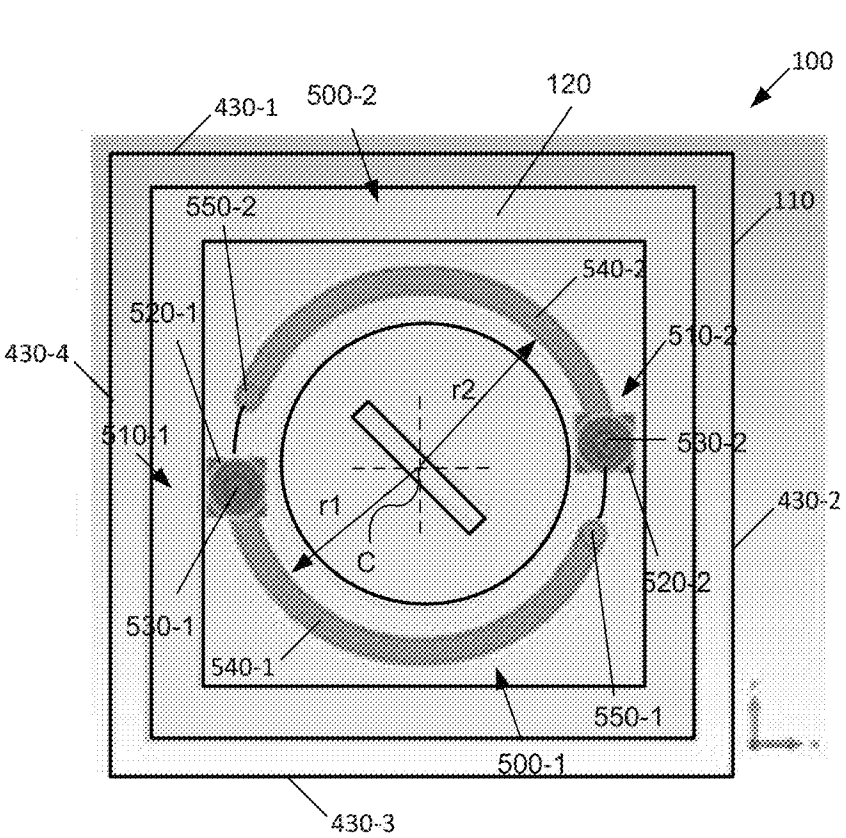
Figure 5C:
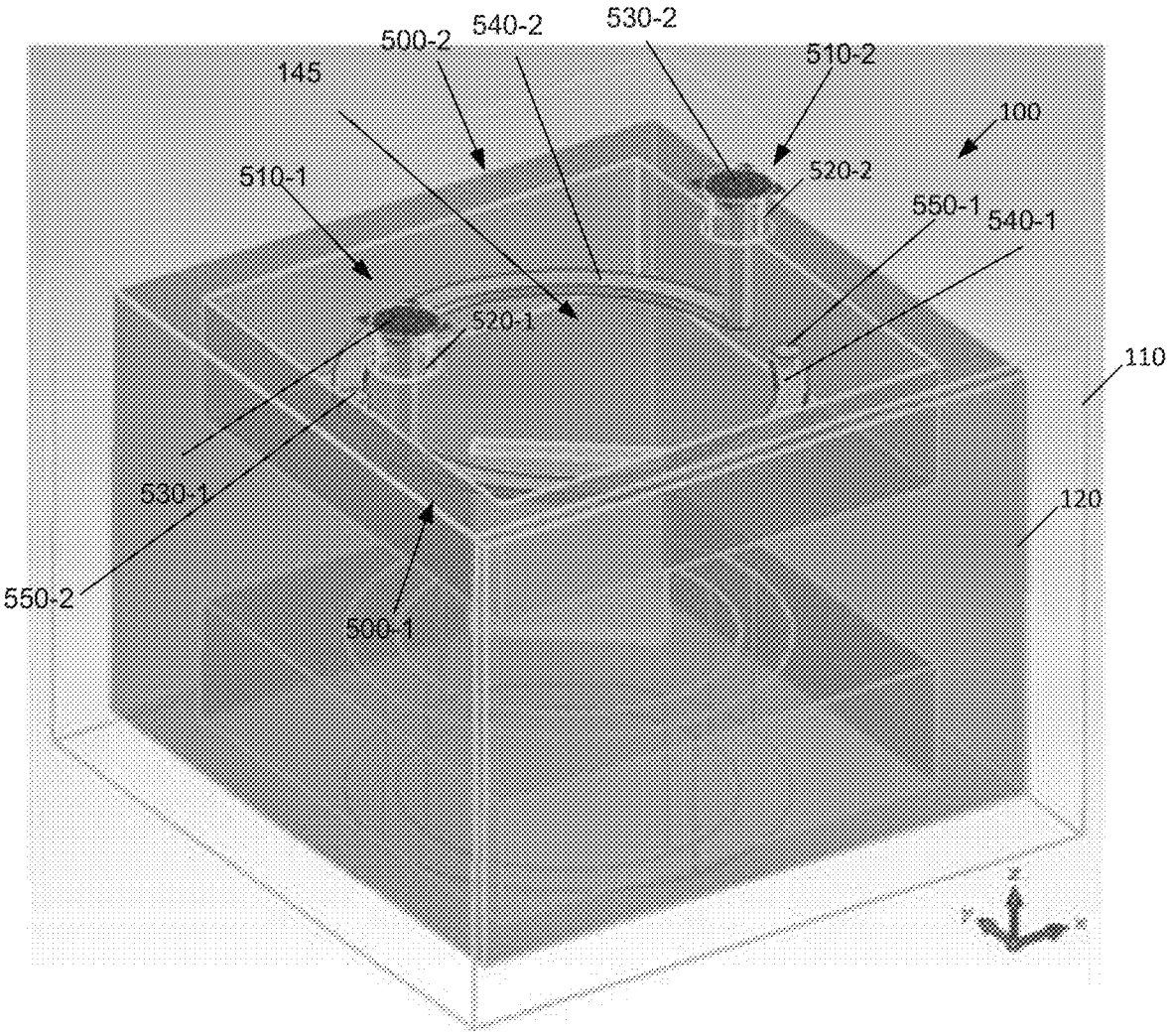

Coupling into a hybrid triple-mode ceramic air cavity filter 100 (or 200 or 300) may be achieved with an open-ended transmission line connected to a coaxial port. FIGS. 5A, 5B, and 5C are different views of the same exemplary hybrid triple-mode ceramic air cavity filter 100 and present coupling structures 500-1 and 500-2 for coupling into and out of a triple-hybrid-mode cavity, in accordance with an exemplary embodiment. FIG. 5A is a top view of the filter, FIG. 5B is a side vide of the filter, and FIG. 5C is a perspective view of the filter. Two coupling structures 500-1 and 500-2 are shown, each comprising (respectively) a coaxial port 510-1, 510-2 comprising a shield 520-1, 520-2 and a center conductor 530-1, 530-2, and an open-ended transmission line 540-1, 540-2. Note that the transmission lines 540 are not marked in FIG. 5B, as they are "on top of" each other in this view. The transmission line 540 is embedded some distance d (see FIG. 5B) into the top of the cavity 111, with a deeper embedding corresponding to an increased amount of coupling. The transmission lines 540 rotate around the inside of the cavity 111, e.g., at some radius r1 from the cavity center (C) for the transmission line 540-1 and at some radius r2 from the cavity center (C) for the transmission line 540-2. See FIG. 5A. It is assumed that r1=r2=r for this description of FIGS. 5A, 5B, and 5C. If a transmission line 540 rotates in a smaller radius r, close to the cavity center C, the TM modes will be coupled stronger, relative to the TE mode. If the line rotates in a larger radius, closer to the cavity side and to the side walls at some radius r from the cavity center (C) for the transmission lines 540-1, 540-2, the TM modes will be coupled weaker, relative to the TE mode. This is due to the field patterns of the modes: the TM modes have magnetic field maximums towards the cavity top face center C, whereas the TE mode has a magnetic field minimum towards the cavity top face center C. For a symmetric filter, radius r1 would always equal radius r2. However, there may be instances when different port loadings (e.g., a low pass filter, LPF, added to one port only) may benefit from having radius r1 not equal to radius r2.

Also, the modes are affected differently as the line length increases, as the line rotates further around the inside of the cavity. Initially, when the line length is short, the coupling to all modes increases as the line length increases. As the line length gets longer, the coupling into the TM modes increases at a slower rate relative to the coupling into the TE mode. This is because the TE current path rotates around the Z axis of the cavity, while the TM current paths travel from the center of one cavity vertical edge to the center of the diagonally opposite cavity vertical edge. This means that as the input line length increases, the coupling into the TE mode will continue to increase up to 360 degrees rotation of the line. However, the TM coupling will stop increasing when the line length reaches 180 degrees, and begin to decrease as the line length increases beyond 180 degrees (with a portion of the input line EM fields now being out-of-phase with the TM mode EM fields), reaching zero coupling as the line reaches 360 degrees. Also, an open-ended vertical stub 550-1, 550-2 can be attached to the end of the input line to further increase coupling.

Figure 5D:
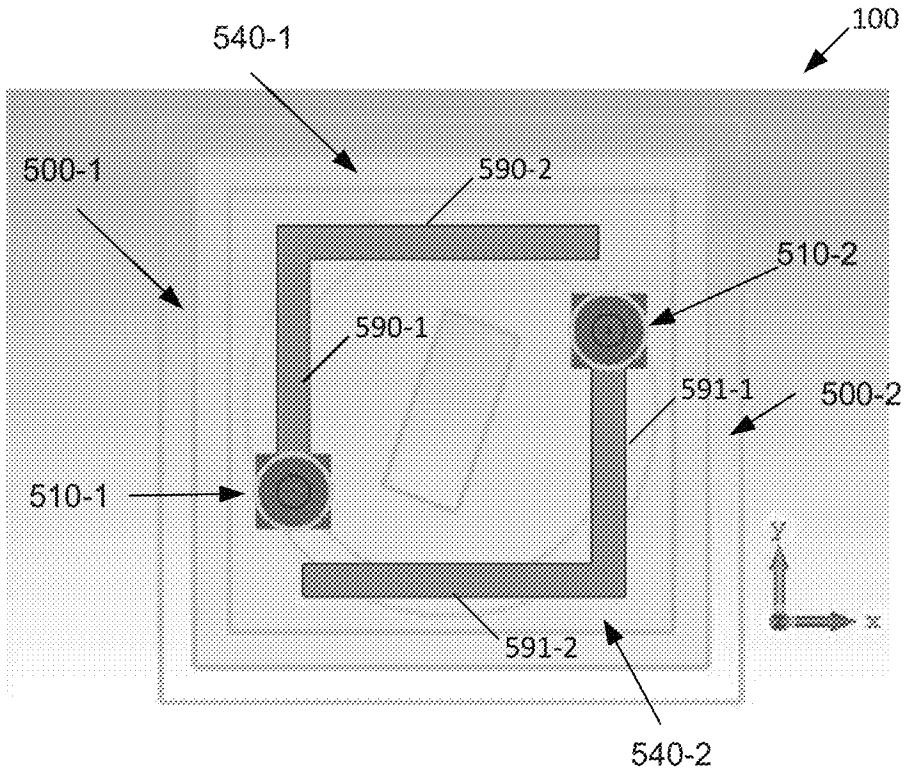
FIG. 5D illustrates a top view of a filter similar to that used in FIGS. 5A, 5B, and 5C, but with open-ended transmission lines with straight sections instead of being circular.

The input line does not necessarily have to be circular but could also be made from straight sections at angles to each other. FIG. 5D illustrates a top view of a filter 100 similar to that used in FIGS. 5A, 5B, and 5C, but with open-ended transmission lines with straight sections instead of the transmission lines being circular. The coupling structures 500-1, 500-2 in this example have the coaxial ports 510-1, 510-2, but the open-ended transmission lines 540-1, 540-2 are made from straight sections: transmission line 540-1 is made from straight sections 590-1 and 590-2 at an angle (e.g., 90 degrees) to each other; and transmission line 540-2 is made from straight sections 591-1 and 591-2 at an angle (e.g., 90 degrees) to each other.

Figure 5E:
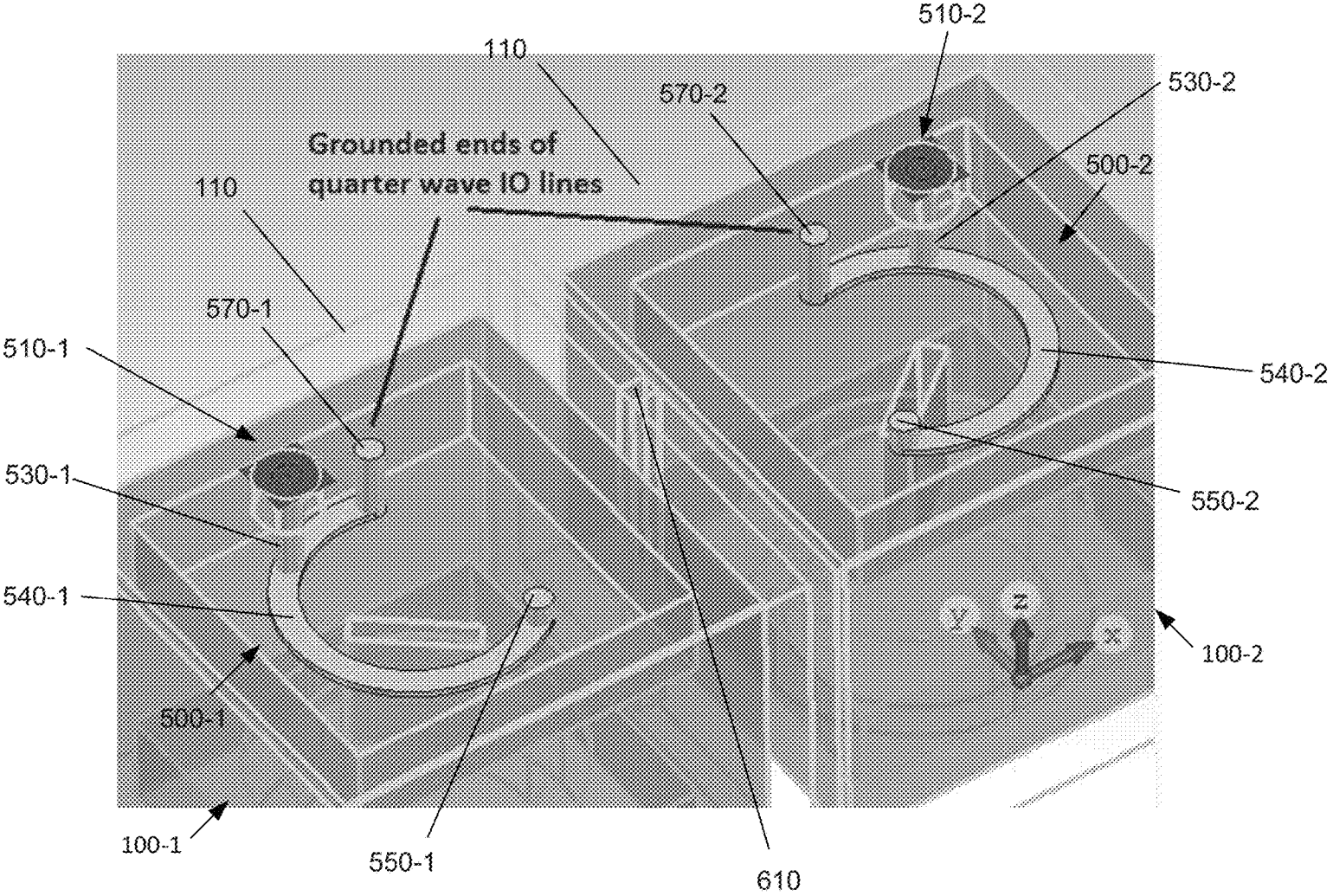
FIG. 5E illustrates a perspective view of two filters similar to those used in FIGS. 5A, 5B, and 5C, but with coupling structures formed to create tapped quarter wave input lines.

Additionally, the input line could be grounded to the top face 410 of the metal structure 110, with the coaxial input conductor 530 offset some distance from the input line end. This results in a tapped quarter wave input line. FIG. 5E illustrates an example of this. FIG. 5E illustrates a perspective view of two of the filters of FIGS. 5A, 5B, and 5C, but with coupling structures formed to create a tapped quarter wave input line. In this example, two filters 100-1 and 100-2 are coupled using a vertical slit iris 610 (described in more detail below, e.g., in reference to FIG. 6). Each filter 100-1, 100-2 has a corresponding and respective coupling structure 500-1, 500-2. Each coupling structure 500-1, 500-2 has a corresponding coaxial port 510-1, 510-2 with a center conductor 530-1, 530-2 and an open-ended transmission line 540-1, 540-2. The transmission line 540-1 has a stub 550-1 and also a grounded end 570-1 which includes a structure electrically connected to the metal structure 110 (e.g., and therefore the grounded end 570-1 is coupled to the metal structure 110, which is grounded). The distance on the transmission line 540-1 between the grounded end 570-1 and the center conductor 530-1 is about one-quarter of the entire length of the transmission line 540-1. The coupling structure 500-1 therefore creates a tapped quarter wave input line. Similarly, the transmission line 540-2 has a stub 550-2 and also a grounded end 570-2, and the distance on the transmission line 540-2 between the grounded end 570-2 and the center conductor 530-2 is about one-quarter of the entire length of the transmission line 540-2. The coupling structure 500-2 also creates a tapped quarter wave input line.

Figure 6:
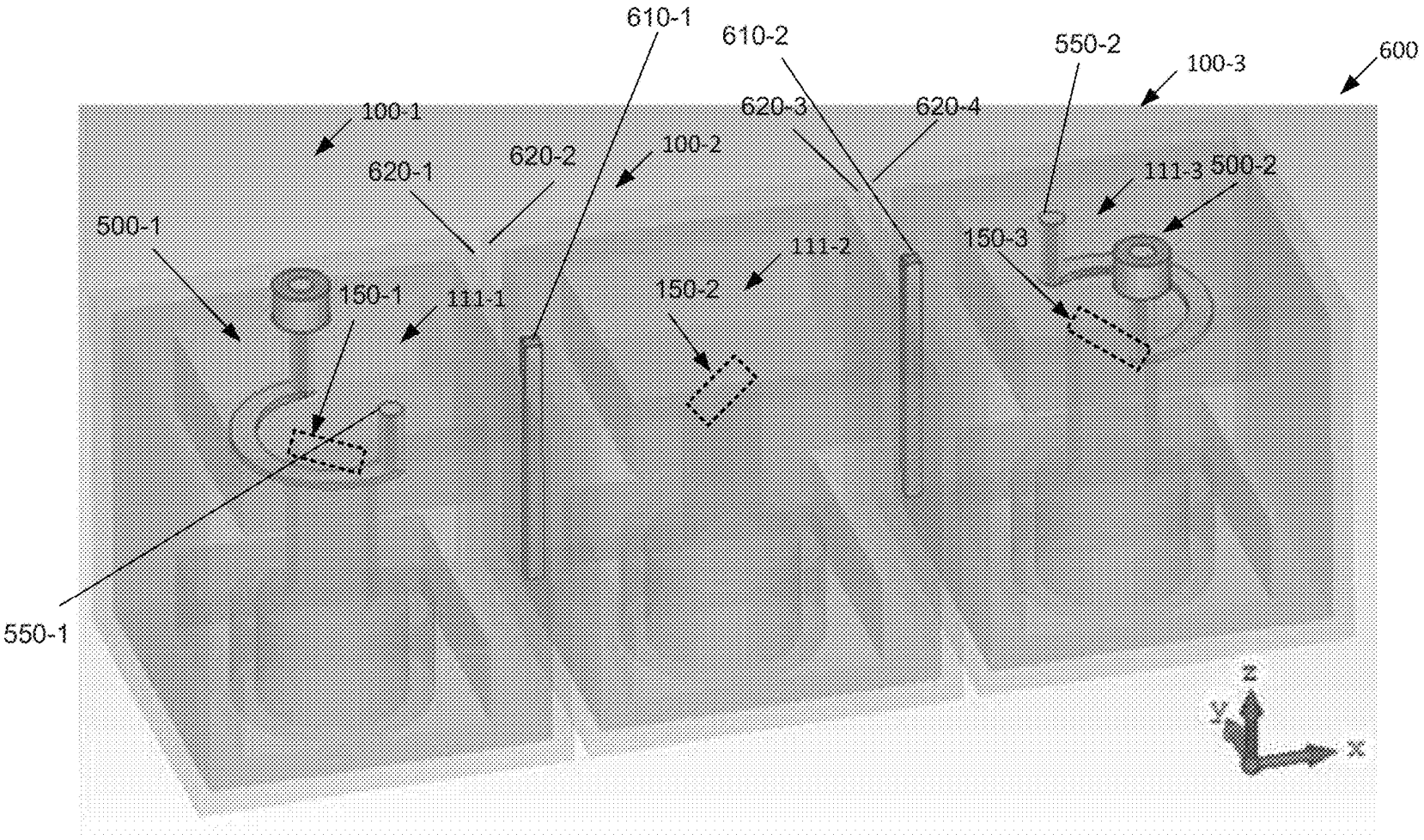
FIG. 6 illustrates coupling between triple-hybrid mode cavities in an exemplary embodiment of a multi-cavity filter with vertical slit irises in the separating cavity walls, and also illustrates stubs on ends of input lines which are more visible in this figure.

Coupling between triple-hybrid mode cavities (as part of multiple filters 100 in a multi-cavity filter) may be achieved with a vertical slit iris in the separating cavity walls. FIG. 6 illustrates coupling between triple-hybrid mode cavities in an exemplary embodiment of a multi-cavity filter 600 with vertical slit irises 610 in the separating cavity walls, and also illustrates stubs on ends of input lines which are more visible in this figure. The stubs 550-1 and 550-2 for the corresponding coupling structures 500-1 and 500-2 are taller than those shown previously, but are not grounded (e.g., contact the metal structure 110). There are three filters 100-1, 100-2, and 100-3, and there is a vertical slit iris 610-1 in separating cavity walls 620-1 and 620-2, and another vertical slit iris 610-2 in separating cavity walls 620-3 and 620-4. In an exemplary embodiment, the slit irises are simply slits in the walls 620-1/620-2 or 620-3/620-4. A taller slit for an iris 610 will lead to increased coupling. The slit for the irises should be thin in order for the inter-cavity electric fields to not "see" each other and destroy the transmission zeros. That is, the slit needs to be narrow in order to reduce the spurious coupling between unwanted modes. If the slit is wide, the attenuation performance of the filter is compromised. It is believed that the narrowness of the slits should be on the order of the wall thickness. It is noted that the slit irises 610 are coupling structures, as they couple radio frequency signals into or out of the filters. Although three filters in series and adjacent to each other are shown, there could be two adjacent filters in series, four adjacent filters in series, and the like.

Figure 7:
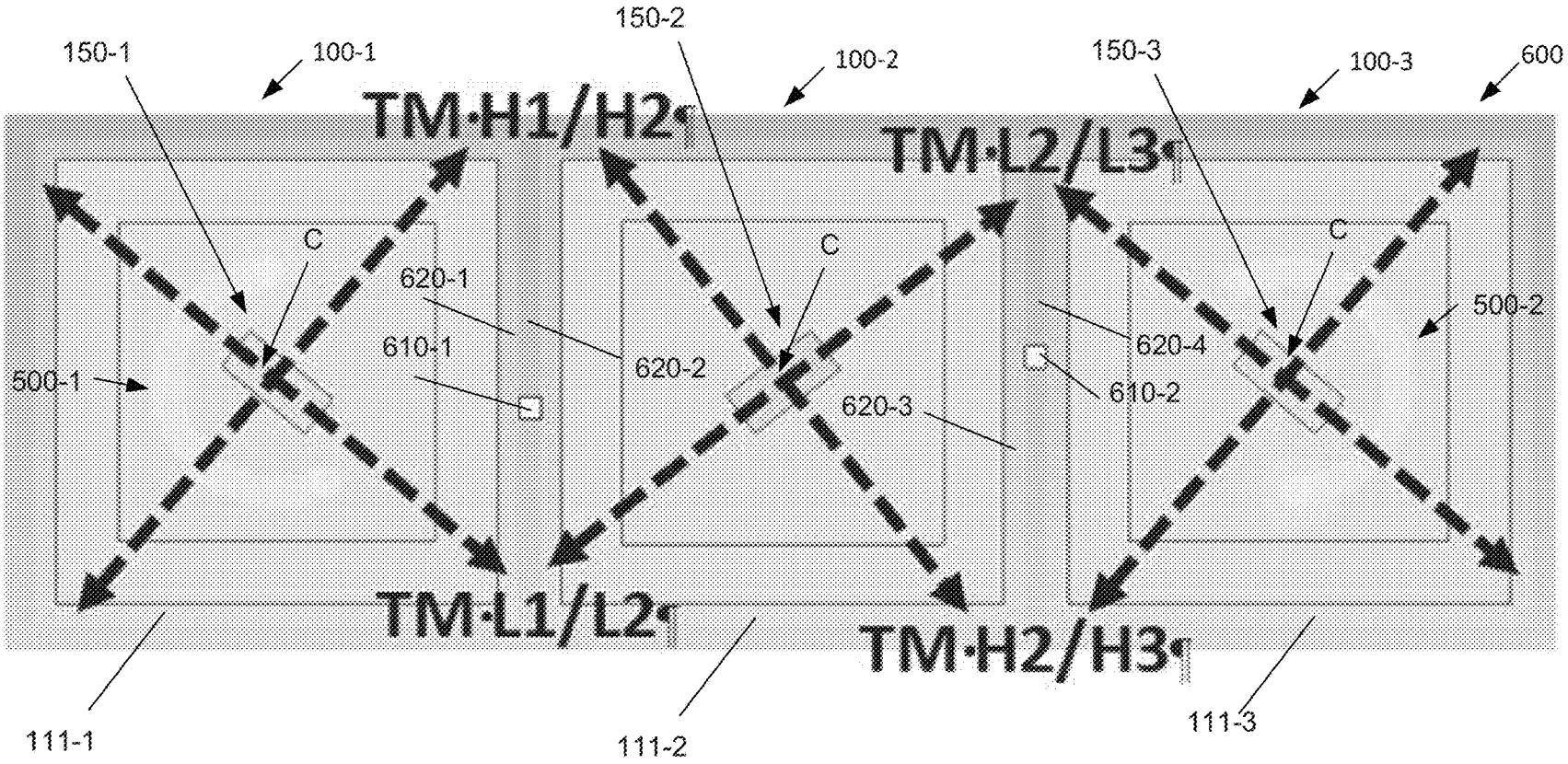
FIG. 7 illustrates adjacent cavities (here 1, 2 and 3), in a multi-cavity filter, that require for proper coupling the TM modes to be rotated 180 degrees such that the electric fields (dotted lines) of the low and high modes (L and H) point towards each other.

Adjacent cavities 111-1, 111-2, and 111-3 (as part of corresponding filters 100-1, 100-2, and 100-3, respectively) require the TM modes to be relatively rotated 180 degrees such that the electric fields of the low modes and high modes point towards each other (see FIG. 7). Note the slots 150-1, 150-2, and 150-3 are rotated by 90 degrees (in both FIGS. 6 and 7). That is, slot 150-2 is rotated 90 degrees from slot 150-1, and slot 150-3 is rotated 90 degrees from slot 150-2. The position of the slit adjusts the degree to which each TM mode is coupled. That is, when the TM modes are rotated 45 degree in the cavity, a slit iris at the separating cavity wall center C will couple equally to each TM mode. However, as the slit iris is moved off center C, one TM mode will tend to couple more than the other TM mode, while the TE coupling remains unchanged. This allows more attenuation on one side of the filter passband than the other. The ratio of the coupling to the TE mode vs the TM modes can be controlled by the cavity aspect ratio, by altering the current paths of the TM and TE modes relative to the vertical slit iris 610. A short, wide cavity 111 will make the TM mode current path weaker across the coupling iris while the TE mode current will be stronger across the coupling iris. This leads to a filter with transmission zeros closer to the pass band and increased selectivity. Similarly, a tall, less wide cavity 111 will make the TM mode current path stronger across the coupling vertical slit iris 610 while the TE mode current will be weaker across the coupling iris. This leads to a filter with transmission zeros further from the pass band and decreased selectivity.

Figure 8:
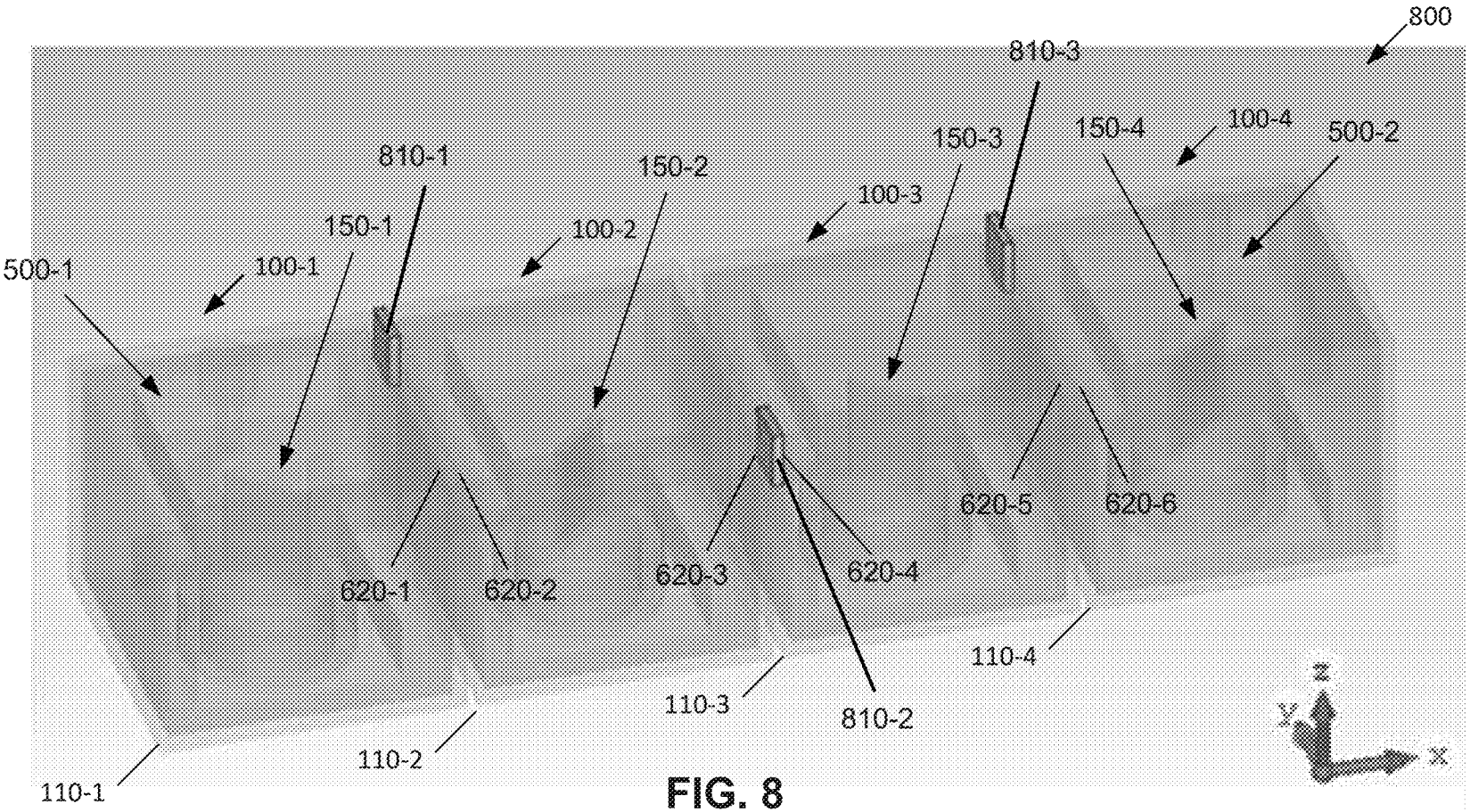
FIG. 8 illustrates square irises placed in the top corners of the separating cavity walls for proper coupling in an exemplary multi-cavity filter.

Also, additional irises can be positioned within the separating cavity wall. A square (or shapes with a similar aspect ratio) iris 810 can be placed in the top corner of the separating side wall 620 (see FIG. 8) for a filter 100. The square irises 810 comprise matching openings in corresponding sidewalls 620 of the metal structure 110 of filters 100. In FIG. 8, there are four filters 100-1, 100-2, 100-3, and 100-4 in series, having separating side walls 610-1 thru 610-6 for metal structures 110-1, 110-2, 110-3, and 110-4, in the multi-cavity filter 800. Note that each slot 150-1 through 150-4 is positioned 90 degrees offset from a previous slot 150 in the series. Square iris 810-1 is placed between separating sidewalls 610-1 and 610-2 of metal structures 110-1 and 110-2. Square iris 810-2 is placed between separating sidewalls 610-3 and 610-4 of metal structures 110-2 and 110-3, and is positioned at an opposite side of the filters 100-2 and 100-3 as is positioned iris 810-1 for filters 100-1 and 100-2. Square iris 810-3 is placed between separating sidewalls 610-5 and 610-5 of metal structures 110-3 and 110-4, and is positioned at an opposite side of the filters 100-3 and 100-4 as is positioned iris 810-2 for filters 100-2 and 100-3. This will couple the electric field of one TM mode to the electric field of the equivalent TM mode in the adjacent cavity, leading to decreased overall coupling (as this electric coupling is out-of-phase with the already dominant magnetic coupling occurring through the vertical slit iris). This allows more control over the transmission zero placements. The square irises 810 could sit in the bottom corners also, but they sit at the top so a tuning screw from the top could be placed in the iris (the tuning screws are not shown in this figure). The square irises 810 could possibly sit halfway down, also, however this would increase the spurious coupling of the electric field of the TE modes which would limit the usefulness.

Figure 9:
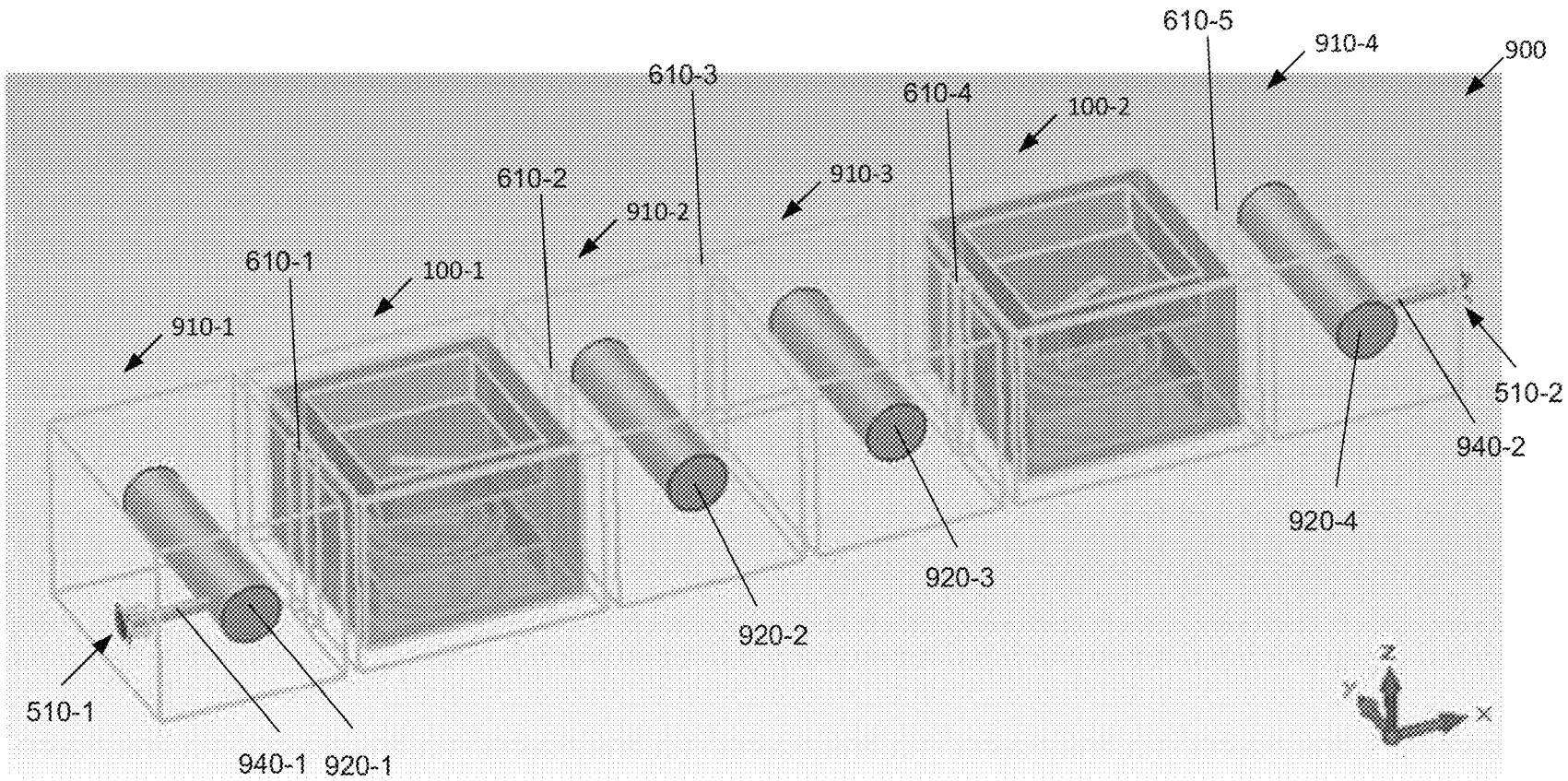
FIG. 9 illustrates air coaxial resonators, in a multi-cavity filter, acting as input and output resonators for the filter, also acting as intermediate resonators between hybrid triple-mode ceramic air cavity filters.

Additionally, a triple-hybrid mode cavity can couple through a vertical slit iris to a horizontally-mounted single-mode air coaxial resonator. This air coaxial resonator could act as an input or output resonator for the filter, or act as an intermediate resonator between triple-hybrid mode cavities (see FIG. 9). FIG. 9 illustrates two filters 100-1 and 100-2 in series with a number of horizontally-mounted single-mode air coaxial resonators 910-1, 910-2, 910-3 and 910-4 in a multi-cavity filter 900. A coaxial port 510-1 provides coupling to (or from) the air coaxial resonator 910-1, which comprises a resonator tube 920-1 via an open-ended transmission line 940-1. The air coaxial resonators 910 are metallic boxes filled with air, with a central, horizontally mounted metallic tube 920. An iris 610-1 is in the sidewalls between the resonator 910 and the filter 100-1. Another iris 610-2 is in the sidewalls between the filter 100-1 and the resonator 910-2, which contains a resonator tube 920-2. A third iris 610-3 is in the sidewalls between the resonators 920-2 and 920-3. Resonator 920-3 contains a resonator tube 920-3, and a fourth iris 610-4 is in the sidewalls between the resonator 910-3 and the filter 100-2. A final iris 610-5 is in the side walls between the filter 100-2 and the final resonator 910-4. The final resonator 910-4 has a resonator tube 920-4, which connects to an open-ended transmission line 940-2, which connects to another coaxial port 510-2.

The shape of the central metallic stub (illustrated in this example by resonator tube 920) of the coaxial resonator 910 can be quite variable, from a fin to a rectangular prism to an extruded star shape to a rod, all of which could be hollow or solid. The hollow rod (i.e., tube) is most commonly used, though, as it is perhaps is cheapest to predict and manufacture and allows a cylindrical tuning screw to be inserted in the open end.

For the examples above with multiple filters in series or multiple filters in series with air coaxial resonators, it is noted that there could be anywhere from two filters to many filters (with air coaxial resonators) in series. There are not really many or any limitations. For instance, there can be one or more than one air coaxial resonator in series at either end of a triple mode cavity or one or more than one in between two triple mode cavities. There could possibly be one (possibly only one) at the end with the input feeding the triple mode cavity, and this is known as an extracted pole filter, but generally this is only used when it is difficult to generate transmission zeros (which is not the case using the embodiments described above). The input and output lines (e.g., the transmission lines) need to be reverse mirror images when there is an odd number of cavities (including a single cavity), however they need only be mirror images when there is an even number of cavities.

Figure 10:
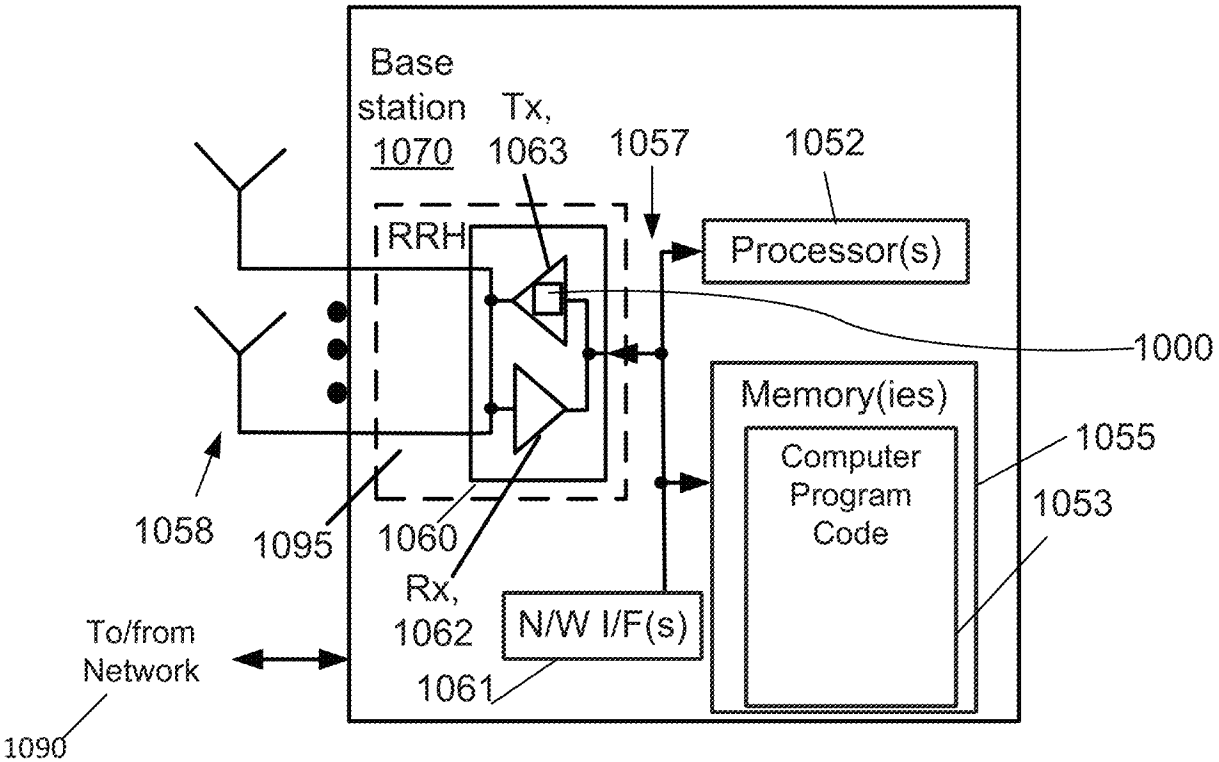
FIG. 10 shows a block diagram a base station (e.g., eNB) implementing any of the filters and corresponding apparatus described herein.

Referring to FIG. 10, this figure shows a block diagram of a base station implementing any of the filters described herein. The instant filters are applicable to many different transmission schemes such as LTE (long term evolution) and other cellular schemes, and in particular to macro base stations, as described by FIG. 10. The macro base stations employ wide coverage, such as providing long range and/or high power relative to other smaller base stations such as pico, micro, or femto cells.

The base station 1070 is a base station (e.g., for LTE, long term evolution, which is referred to as an eNB) that provides access by wireless devices to the wireless, cellular and/or other network 1090. The base station 1070 includes one or more processors 1052, one or more memories 1055, one or more network interfaces (N/W I/F(s)) 1061, and one or more transceivers 1060 interconnected through one or more buses 1057. Each of the one or more transceivers 1060 includes a receiver, Rx, 1062 and a transmitter, Tx, 1063. The one or more memories 1055 include computer program code 1053, which may be used to control the base station 1070, at least in part. The one or more transceivers 1060 are connected to one or more antennas 1058. The one or more network interfaces 1061 communicate over a network such as a wireless network. The one or more buses 1057 may be address, data, or control buses, and may include any interconnection mechanism, such as a series of lines on a motherboard or integrated circuit, fiber optics or other optical communication equipment, wireless channels, and the like. For example, the one or more transceivers 1060 may be implemented as a remote radio head (RRH) 1095, with the other elements of the eNB 1070 being physically in a different location from the RRH, and the one or more buses 1057 could be implemented in part as fiber optic cable to connect the other elements of the base station 1070 to the RRH 1095.

The transmitter 1063 can implement filter 1000, which may be any of the filters described above. Additionally, the filter 1000 is not limited to those specific examples and may vary from those examples.

Without in any way limiting the scope, interpretation, or application of the claims appearing below, a technical effect of one or more of the example embodiments disclosed herein is to provide a compact transmit filter, such as for use for a base station, e.g., for a macro cell, with very low insertion loss (high Q), high power handling, good tunability and sharp selectivity.

The following are additional examples.

Example 1

An apparatus, comprising: a filter comprising: a metal structure forming a cavity; a ceramic block suspended in the cavity, the ceramic block having two removed portions, the removed portions removed from two opposing sides of the ceramic block, the ceramic block further having one or more slots that that span a region of ceramic between the two removed portions and connects chambers formed by the two regions with chambers formed by the one or more slots, wherein a combined structure of the ceramic block, cavity, and metal structure supports multiple fundamental TM modes and one fundamental TE mode; and multiple coupling structures to couple radio frequency signals into and out of the filter.

Example 2

The apparatus of example 1, wherein: the metal structure has a cuboid shape; the ceramic block has a cuboid shape; and each of the two removed portions has a rectangular box shape.

Example 3

The apparatus of example 2, wherein the one or more slots is a single slot having a rectangular box shape, wherein a rectangle of the rectangular box shape has two dimensions and one dimension of the rectangle is much longer than the other dimension, a center of the rectangle is aligned with a center of the ceramic block, a depth of the rectangular box shape is formed by two opposing sides of the two removed portions, and the rectangle is rotated, in a plane parallel to opposing surfaces of the removed portions, by a certain number of degrees between zero and 90 around the cavity center, relative to a starting point based on an axis in the plane that is parallel to one side wall in that plane of the metal structure.

Example 4

The apparatus of example 3, wherein the rectangle is rotated, in the plane, by a certain number of degrees between zero and 90 around the cavity center from a starting point where a long axis along the long dimension of the rectangle is parallel to one side wall of the metal structure.

Example 5

The apparatus of example 2, wherein the one or more slots are one of the following: formed as a single slot from a single ellipsoid shape; formed as a single slot from an off-center cylindrical hole; or formed as multiple slots from multiple holes.

Example 6

The apparatus of example 1, wherein: the metal structure has a cylindrical shape; the ceramic block has a cylindrical shape; each of the two removed portions has a cylindrical shape; the one or more slots is a single slot having an ellipsoidal box shape, wherein an ellipse of the ellipsoidal box shape has two dimensions and one axis of the ellipse is much longer than the other axis, a center of the ellipse is aligned with a center of the ceramic block, a depth of the ellipsoidal box shape is formed by two opposing sides of the two removed portions, and the ellipse is rotated, in a plane parallel to opposing surfaces of the removed portions, by a certain number of degrees between zero and 90 around the cavity center, relative to a starting point based on an axis of the cylinder in the plane.

Example 7

The apparatus of examples 1-6, further comprising at least one metal grounding screw grounded to the metal structure, which itself is at a ground potential, the at least one metal grounding screw in a surface of the metal structure opposite to a selected removed portion, the at least one metallic grounding screw positioned above a ceramic ridge surrounding the selected removed portion.

Example 8

The apparatus of examples 1-7, further comprising at least one metal grounding screw grounded to the metal structure, which itself is at a ground potential, the at least one metal grounding screw in a surface of the metal structure perpendicular to opposing surfaces of the removed portions.

Example 9

The apparatus of examples 1-8, further comprising an insulated screw, the insulated screw in a surface of the metal structure opposite to a selected removed portion, the insulated screw positioned above the selected removed portion and comprising a metal disc and a plastic screw, the plastic screw touching metal structure and the metal disk insulated at least by the plastic screw from the metal structure.

Example 10

The apparatus of examples 1-9, wherein each of the first and second coupling structures comprises: a coaxial port comprising a shield coupled to the metal structure, and a center conductor insulated from the metal structure; and an open-ended transmission line coupled to the center conductor, the line embedded a distance d into the cavity from a surface of the metal structure that is opposite from and parallel to a surface of a selected removed portion, where the surface of the selected removed portion is parallel to a surface of the other removed portion, Example 11

The apparatus of example 10, wherein each open-ended transmission line comprises a transmission line curved in an arc at some radius from a center of the ceramic block.

Example 12

The apparatus of example 11, wherein the radius of one of the two open-ended transmission lines is a same as the radius of the other of the two open-ended transmission lines.

Example 13

The apparatus of example 11, wherein the radius of one of the two open-ended transmission lines is different from the radius of the other of the two open-ended transmission lines.

Example 14

The apparatus of example 11, wherein, for each of the open-ended transmission lines, a center conductor of the coaxial port is coupled to the transmission line at a location about one-fourth a length of the transmission line, and an end of the transmission line nearest the center conductor connects to a structure that electrically connects to the metal structure, to create two tapped quarter wave input lines.

Example 15

The apparatus of example 10, wherein each open-ended transmission line comprises a transmission line having two straight sections at an angle of 90 degrees from each other.

Example 16

The apparatus of example 10, wherein each open-ended transmission line comprises a stub on an end of the line opposite an end of the line coupled to the center conductor.

Example 17

The apparatus of examples 1-16, further comprising an insulating support having a first side abutting a side of the metal structure and having a second side abutting a surface of a selected removed portion, where the surface of the selected removed portion is parallel to a surface of the other removed portion.

Example 18

The apparatus of example 17, wherein the insulating support comprises alumina.

Example 19

The apparatus of examples 1-18, wherein: the apparatus comprises multiple ones of the filters in series and adjacent to each other from a first filter to an ending filter; a coupling structure for the first filter comprises a coaxial port coupled to a transmission line, and the other coupling structure for the first filter comprises an iris in a sidewall of the metal structure, the iris used to couple the first filter to a next filter in the series; a coupling structure for the ending filter comprises an iris in a sidewall of the metal structure, the iris used to couple the ending filter to a previous filter in the series, and the other coupling structure for the ending filter comprises a coaxial port coupled to a transmission line; for any filters between the first filter and the ending filter, a coupling structure comprises an iris that aligns with an iris for a previous filter in the series, and the other coupling structure comprises an iris that aligns with an iris for a next filter in the series.

Example 20

The apparatus of example 19, wherein the irises comprise vertical irises located in a middle of a corresponding sidewall.

Example 21

The apparatus of example 19, wherein the irises comprise square irises located at a corner of a corresponding sidewall.

Example 22

The apparatus of example 19, wherein for each pair of adjacent filters, the slots are positioned out of phase by 90 degrees.

Example 23

The apparatus of examples 1-18, wherein: the apparatus comprises a multi-cavity filter comprising one or more of the filters and a plurality of air coaxial resonators; there is a series of cavity filters from a starting air coaxial resonator, through one or more of the filters and zero or more of the coaxial resonators, ending at an ending air coaxial resonator, each air coaxial resonator comprising a metal box filled with air and comprising a central, horizontally mounted metallic stub; a coupling structure for the starting air coaxial resonator comprises a coaxial port coupled to a line connected to the metallic stub of the starting air coaxial resonator, and another coupling structure for the starting air coaxial resonator comprises an iris in a sidewall of the metallic box, the sidewall opposite the coaxial port, the iris used to couple signals from the starting air coaxial resonator to a next cavity filter in the series; for any intermediate air coaxial resonators or filters in the series between the starting and ending air coaxial resonators, the intermediate air coaxial resonators or filters comprise irises in two opposing sidewalls for coupling signals to or from other cavity filters in the series; and a coupling structure for the ending air coaxial resonator comprises an iris in a sidewall of the metallic box for the ending air coaxial resonator, the iris used to couple the ending air coaxial resonator to a previous cavity filter in the series, and another coupling structure for the ending air coaxial resonator comprises a coaxial port coupled to a line connected to the stub for the ending air coaxial resonator.

24

The apparatus of examples 1-23, comprising a transmitter that comprises the filter.

The apparatus of example 24, comprising a base station that comprises the transmitter.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. An apparatus, comprising:

a filter comprising:

a metal structure forming a cavity, wherein the metal structure has a cuboid shape;

a ceramic block suspended in the cavity, the ceramic block having a cuboid shape, the ceramic block has two removed portions, the removed portions removed from two opposing sides of the ceramic block, each of the two removed portions has a rectangular box shape, the ceramic block further having one or more slots that span a region of ceramic between the two removed portions and connects chambers formed by the two regions with chambers formed by the one or more slots, wherein a combined structure of the ceramic block, cavity, and metal structure supports multiple fundamental TM modes and one fundamental TE mode; and multiple coupling structures to couple radio frequency signals into and out of the filter.

2. The apparatus of claim 1, wherein:

the apparatus comprises a multi-cavity filter comprising one or more of the filters and a plurality of air coaxial resonators;

there is a series of cavity filters from a starting air coaxial resonator, through one or more of the filters and zero or more of the coaxial resonators, ending at an ending air coaxial resonator, each air coaxial resonator comprising a metal box filled with air and comprising a central, horizontally mounted metallic stub;

a coupling structure for the starting air coaxial resonator comprises a coaxial port coupled to a line connected to the metallic stub of the starting air coaxial resonator, and another coupling structure for the starting air coaxial resonator comprises an iris in a sidewall of the metallic box, the sidewall opposite the coaxial port, the iris used to couple signals from the starting air coaxial resonator to a next cavity filter in the series;

for any intermediate air coaxial resonators or filters in the series between the starting and ending air coaxial resonators, the intermediate air coaxial resonators or filters comprise irises in two opposing sidewalls for coupling signals to or from other cavity filters in the series; and a coupling structure for the ending air coaxial resonator comprises an iris in a sidewall of the metallic box for the ending air coaxial resonator, the iris used to couple the ending air coaxial resonator to a previous cavity filter in the series, and another coupling structure for the ending air coaxial resonator comprises a coaxial port coupled to a line connected to the stub for the ending air coaxial resonator.

3. The apparatus of claim 1, wherein the one or more slots is a single slot having a rectangular box shape, wherein a rectangle of the rectangular box shape has two dimensions and one dimension of the rectangle is much longer than the other dimension, a center of the rectangle is aligned with a center of the ceramic block, a depth of the rectangular box shape is formed by two opposing sides of the two removed portions, and the rectangle is rotated, in a plane parallel to opposing surfaces of the removed portions, by a certain number of degrees between zero and 90 around the cavity center, relative to a starting point based on an axis in the plane that is parallel to one side wall in that plane of the metal structure.

4. The apparatus of claim 3, wherein the rectangle is rotated, in the plane, by a certain number of degrees between zero and 90 around the cavity center from a starting point where a long axis along the long dimension of the rectangle is parallel to one side wall of the metal structure.

5. The apparatus of claim 1, wherein the one or more slots are one of the following: formed as a single slot from a single ellipsoid shape; formed as a single slot from an off-center cylindrical hole; or formed as multiple slots from multiple holes.

6. The apparatus of claim 1, further comprising an insulated screw, the insulated screw in a surface of the metal structure opposite to a selected removed portion, the insulated screw positioned above the selected removed portion and comprising a metal disc and a plastic screw, the plastic screw touching the metal structure and the metal disk insulated at least by the plastic screw from the metal structure.

7. The apparatus of claim 1, further comprising at least one metal grounding screw grounded to the metal structure at a ground potential, the at least one metal grounding screw in a surface of the metal structure opposite to a selected removed portion, the at least one metallic grounding screw positioned above a ceramic ridge surrounding the selected removed portion.

8. The apparatus of claim 1, further comprising at least one metal grounding screw grounded to the metal structure at a ground potential, the at least one metal grounding screw in a surface of the metal structure perpendicular to opposing surfaces of the removed portions.

9. The apparatus of claim 1, further comprising an insulating support having a first side abutting a side of the metal structure and having a second side abutting a surface of a selected removed portion, where the surface of the selected removed portion is parallel to a surface of another removed portion.

10. The apparatus of claim 9, wherein the insulating support comprises alumina.

11. The apparatus of claim 1, comprising a transmitter that comprises the filter.

12. The apparatus of claim 11, comprising a base station that comprises the transmitter.

13. An apparatus, comprising:

a filter comprising:

a metal structure forming a cavity;

a ceramic block suspended in the cavity, the ceramic block having two removed portions, the removed portions removed from two opposing sides of the ceramic block, the ceramic block further having one or more slots that span a region of ceramic between the two removed portions and connects chambers formed by the two regions with chambers formed by the one or more slots, wherein a combined structure of the ceramic block, cavity, and metal structure supports multiple fundamental TM modes and one fundamental TE mode; and multiple coupling structures to couple radio frequency signals into and out of the filter, wherein the multiple coupling structures comprise first and second coupling structures and each of the first and second coupling structures comprises:

a coaxial port comprising a shield coupled to the metal structure, and a center conductor insulated from the metal structure; and an open-ended transmission line coupled to the center conductor, the line embedded a distance d into the cavity from a surface of the metal structure that is opposite from and parallel to a surface of a selected removed portion, where the surface of the selected removed portion is parallel to a surface of the other removed portion.

14. The apparatus of claim 13, comprising a transmitter that comprises the filter.

15. The apparatus of claim 13, wherein each open-ended transmission line comprises a transmission line having two straight sections at an angle of 90 degrees from each other.

16. The apparatus of claim 13, wherein each open-ended transmission line comprises a stub on an end of the line opposite an end of the line coupled to the center conductor.

17. The apparatus of claim 13, wherein each open-ended transmission line comprises a transmission line curved in an arc at a radius from a center of the ceramic block.

18. The apparatus of claim 17, wherein the radius of one of the two open-ended transmission lines is the same as the radius of the other of the two open-ended transmission lines.

19. The apparatus of claim 17, wherein the radius of one of the two open-ended transmission lines is different from the radius of the other of the two open-ended transmission lines.

20. The apparatus of claim 17, wherein, for each of the open-ended transmission lines, a center conductor of the coaxial port is coupled to the transmission line at a location about one-fourth a length of the transmission line, and an end of the transmission line nearest the center conductor connects to a structure that electrically connects to the metal structure, to create two tapped quarter wave input lines.

21. An apparatus, comprising:

a filter comprising:

a metal structure forming a cavity;

a ceramic block suspended in the cavity, the ceramic block having two removed portions, the removed portions removed from two opposing sides of the ceramic block, the ceramic block further having one or more slots that that span a region of ceramic between the two removed portions and connects chambers formed by the two regions with chambers formed by the one or more slots, wherein a combined structure of the ceramic block, cavity, and metal structure supports multiple fundamental TM modes and one fundamental TE mode; and multiple coupling structures to couple radio frequency signals into and out of the filter, wherein:

the apparatus comprises multiple ones of the filters in series and adjacent to each other from a first filter to an ending filter;

a coupling structure for the first filter comprises a coaxial port coupled to a transmission line, and another coupling structure for the first filter comprises an iris in a sidewall of the metal structure, the iris used to couple the first filter to a next filter in the series;

a coupling structure for the ending filter comprises an iris in a sidewall of the metal structure, the iris used to couple the ending filter to a previous filter in the series, and another coupling structure for the ending filter comprises a coaxial port coupled to a transmission line;

for any filters between the first filter and the ending filter, a coupling structure comprises an iris that aligns with an iris for a previous filter in the series, and another coupling structure comprises an iris that aligns with an iris for a next filter in the series.

22. The apparatus of claim 21, wherein for each pair of adjacent filters, the slots are positioned out of phase by 90 degrees.

23. The apparatus of claim 21, wherein the irises comprise vertical irises located in a middle of a corresponding sidewall.

24. The apparatus of claim 21, wherein the irises comprise square irises located at a corner of a corresponding sidewall.

25. An apparatus, comprising:

a filter comprising:

a metal structure forming a cavity;

a ceramic block suspended in the cavity, the ceramic block has two removed portions, the removed portions removed from two opposing sides of the ceramic block, the ceramic block further having one or more slots that span a region of ceramic between the two removed portions and connects chambers formed by the two regions with chambers formed by the one or more slots, wherein a combined structure of the ceramic block, cavity, and metal structure supports multiple fundamental TM modes and one fundamental TE mode; and multiple coupling structures to couple radio frequency signals into and out of the filter, wherein:

the metal structure has a cylindrical shape;

the ceramic block has a cylindrical shape;

each of the two removed portions has a cylindrical shape;

the one or more slots is a single slot having an ellipsoidal box shape, wherein an ellipse of the ellipsoidal box shape has two dimensions and one axis of the ellipse is much longer than another axis, a center of the ellipse is aligned with a center of the ceramic block, a depth of the ellipsoidal box shape is formed by two opposing sides of the two removed portions, and the ellipse is rotated, in a plane parallel to opposing surfaces of the removed portions, by a certain number of degrees between zero and 90 around the cavity center, relative to a starting point based on an axis of the cylindrical shape of the ceramic block in the plane.

* * * * *